US008590277B2

(12) United States Patent
Baroni et al.

(10) Patent No.: US 8,590,277 B2
(45) Date of Patent: Nov. 26, 2013

(54) ROTARY CONVEYOR COMPRISING A GRIPPER MECHANISM

(75) Inventors: Marco Baroni, Barbasso di Roncoferraro (IT); Gianpietro Zanini, Montanara di Curtatone (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 469 days.

(21) Appl. No.: 12/989,345

(22) PCT Filed: Apr. 20, 2009

(86) PCT No.: PCT/IB2009/051619

§ 371 (c)(1),
(2), (4) Date: Oct. 22, 2010

(87) PCT Pub. No.: WO2009/130657

PCT Pub. Date: Oct. 29, 2009

(65) Prior Publication Data

US 2011/0041456 A1 Feb. 24, 2011

(30) Foreign Application Priority Data

Apr. 23, 2008 (IT) ..... BO2008A0259

(51) Int. Cl.
*B65B 7/28* (2006.01)

(52) U.S. Cl.
USPC ..... 53/329; 53/490; 53/317; 53/300; 53/319; 53/331.5

(58) Field of Classification Search
USPC ..... 53/287, 317, 300, 331.5, 329, 490, 318, 53/319, 334, 420
See application file for complete search history.

(56) References Cited

U.S. PATENT DOCUMENTS 2,187,429 A 1/1940 Newey
2,684,141 A * 7/1954 Pim ..... 192/61

(Continued)

FOREIGN PATENT DOCUMENTS

DE 9419402 2/1995
DE 19523659 9/1996

OTHER PUBLICATIONS

International Search Report and Written Opinion dated Jul. 14, 2009.

*Primary Examiner* — Alexandra Elve
*Assistant Examiner* — Eyamindae Jallow
(74) *Attorney, Agent, or Firm* — Timothy J. Klima; Shuttleworth & Ingersoll, PLC

(57) ABSTRACT

The components of a rotary conveyor (1) for a carousel type capping machine (2) include a center shaft aligned on a main axis (X) coinciding with the main axis of the machine (2), a carrier element (4) coupled to the shaft so that the two rotate as one about the main axis (X), and a set of gripper mechanisms (5) associated operationally with the carrier element (4), distributed circumferentially about the supporting shaft. Each gripper mechanism (5) is switchable between a first configuration, establishing a recess (6) in which to accommodate a respective container (3), a second configuration in which the container (3) is retained within the recess (6) by a predetermined gripping force, and a third configuration in which the container (3) is restrained by a gripping force greater than the force exerted in the second configuration, so as to counteract any unwanted rotation of the container (3) about its longitudinal axis (Y) that might be induced during the course of capping operations.

19 Claims, 2 Drawing Sheets

(56) References Cited

U.S. PATENT DOCUMENTS

| | | | | | |
|---|---|---|---|---|---|
| 3,087,596 | A * | 4/1963 | Fulton | 198/441 |
| 3,155,228 | A * | 11/1964 | Norwood | 198/803.7 |
| 4,172,541 | A * | 10/1979 | Harris et al. | 222/519 |
| 4,535,583 | A * | 8/1985 | Tanaka et al. | 53/75 |
| 4,614,077 | A * | 9/1986 | Muto et al. | 53/490 |
| 4,616,466 | A * | 10/1986 | Tanaka et al. | 53/75 |
| 4,939,890 | A * | 7/1990 | Peronek et al. | 53/486 |
| 4,984,680 | A * | 1/1991 | Hamano | 198/803.9 |
| 5,743,377 | A * | 4/1998 | Kronseder | 198/803.9 |
| 5,778,633 | A * | 7/1998 | Sweeny | 53/201 |
| 5,816,029 | A * | 10/1998 | Sweeny | 53/490 |
| 6,662,526 | B2 * | 12/2003 | Riggs et al. | 53/308 |
| 6,874,301 | B2 * | 4/2005 | Kitamoto | 53/490 |
| 6,948,297 | B2 * | 9/2005 | Kitamoto | 53/490 |
| 7,024,837 | B2 * | 4/2006 | Takebe et al. | 53/490 |
| 7,434,857 | B2 * | 10/2008 | Nakajima et al. | 294/116 |
| 2001/0018820 | A1 * | 9/2001 | Kitamoto | 53/490 |
| 2006/0242929 | A1 * | 11/2006 | Servadei et al. | 53/490 |
| 2008/0035099 | A1 * | 2/2008 | Yamashita et al. | 123/196 R |
| 2008/0038099 | A1 * | 2/2008 | Burgmeier | 414/222.01 |
| 2009/0014615 | A1 * | 1/2009 | Hausladen | 248/311.2 |

* cited by examiner

ROTARY CONVEYOR COMPRISING A GRIPPER MECHANISM

This application is the National Phase of International Application PCT/IB2009/051619 filed Apr. 20, 2009 which designated the U.S. and that International Application was published under PCT Article 21(2) in English.

This application claims priority to Italian Patent Application No. BO2008A000259 filed Apr. 23, 2008, and PCT Application No. PCT/IB2009/051619 filed Apr. 20, 2009, which applications are incorporated by reference herein.

TECHNICAL FIELD

The present invention relates to rotary conveyor for production machines designed to handle containers, and in particular for capping machines.

The present invention relates also to a capping machine equipped with the rotary conveyor described and illustrated.

The present invention finds application to advantage in the art field of carousel type machines for processing containers intended to hold products of both liquid and powder consistency, preferably food products; such machines include cappers, for example, which in the course of a given handling operation can generate forces liable at least to induce a rotation of the containers about their longitudinal axes.

More exactly, the conveyor to which the invention relates is suitable for use in association with a capping machine, where incoming containers are engaged by respective capping units of which the function is to place a cap on each of the successive containers by means of an appropriately designed gripper mechanism.

BACKGROUND ART

Conventionally, capping machines of the type in question are equipped with at least one rotary conveyor mounted to the central shaft of the carousel together with the capping units, in such a way as to rotate as one with these same units about the main axis of the machine.

The aforementioned rotary conveyor lies beneath the carousel drum, by which the capping units are carried during operation, and establishes a substantially circular trajectory or path extending between a container infeed station and a container outfeed station.

In particular, containers are taken up from the infeed station by the rotary conveyor and carried to the outfeed station, where they will be released after undergoing one or more operations performed by the capping units, that is to say after being capped and sealed.

To this end, the prior art embraces various types of rotary conveyors.

A first type of conveyor is equipped with a plurality of recesses distributed circumferentially about the main axis of the machine, each designed to accommodate a single container for processing, at least in part. The conveyor also presents one or more lateral restraints associated with the recesses, serving to guide the containers along the circular path and around the main axis of the machine. The containers advance with their side walls sliding against the lateral restraints and their bases resting on a common platform.

The prior art embraces other types of conveyor making no use of a fixed lateral restraint, but rather, furnished with a suitable system of pressure belts by which the containers being capped are held forcibly against the respective recesses. The recesses are faced with a material having a high coefficient of friction, so that the action of the belts and the grip afforded by the facings of the recesses will combine more effectively to counteract the rotational forces induced by the capping units.

Finally, the prior art includes conveyors with recesses created by the jaws of respective gripper mechanisms. The jaws can be spread in order to admit the respective container, and thereupon closed by suitable spring means. Thus, the containers are retained and carried along the circumferential conveying path with no need for a lateral restraint of any description.

Whilst the conventional conveyors described above are able to transfer containers efficiently from an infeed station to an outfeed station of a machine by which the selfsame containers are processed, the systems adopted are not without certain drawbacks and might be improved in various ways, mainly as regards counteracting the rotational movements that tend to be induced in the containers in the course of their being handled, for example when caps are fitted, and maintaining the structural integrity of the selfsame containers during their passage from the infeed to the outfeed station.

The applicant finds, in particular, that because the containers are not restrained satisfactorily during the capping operation, there is the risk that a single container can rotate together with the cap being applied, and with the respective capping head. In other words, a container can be forced into rotation by the action of the respective capping unit, with the result that the closure may be insufficiently secure, and the container itself may emerge with scratches or other surface damage caused by the body rubbing against the recesses, the restraints, the belts or the gripper jaws.

It will be appreciated also, in the case of conveyors equipped with complex pressure belt systems, that these systems are difficult to clean or wash and have a high maintenance requirement in terms of the need for replacement and adjustment of the various parts subject to wear, namely the belts and the relative mechanical drive transmission components.

Moreover, a change in the size or style of container handled by the capping machine involves lengthy interruptions to the production cycle, since the changeover dictates replacement both of the parts creating the recesses by which the containers are accommodated, and of the support element or disc carrying the recesses, which normally will be keyed onto a shaft of the machine.

DISCLOSURE OF THE INVENTION

The object of the present invention, accordingly, is to overcome the drawbacks associated with the prior art.

The main object of the present invention is to provide a rotary conveyor for production machines designed to handle containers, in particular capping machines, and/or a capping machine equipped with the rotary conveyor to which the invention relates, such as will be capable of restraining containers securely in the course of handling operations when the single containers are subjected to appreciable rotational forces, as exerted for example by capping units.

A further object of the invention is to provide a conveyor such as will preserve the structural integrity of containers during the aforementioned handling operations.

Another object of the invention is to simplify and speed up the procedure whereby the dimensions of the recesses are changed to accommodate a different size or style of container in production.

The aforementioned objects and others besides are substantially realized in a rotary conveyor for production machines designed to handle containers, in particular capping machines, and in a capping machine equipped with such a rotary conveyor, as characterized in the appended claims.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

Figure 1:
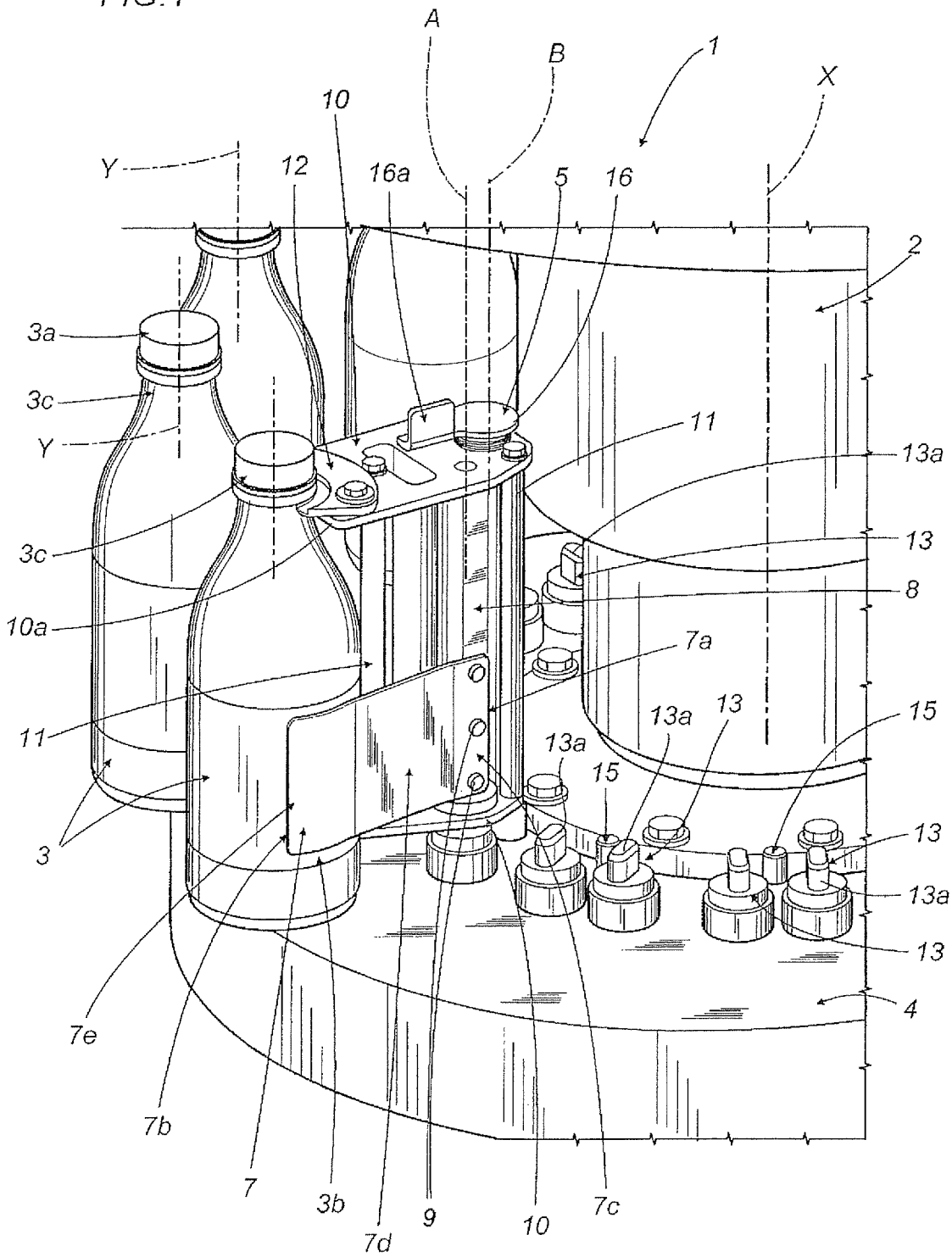
FIG. 1 illustrates a rotary conveyor in accordance with the present invention, viewed fragmentarily and in perspective, fitted to a production machine designed to handle containers.

With reference to the accompanying drawings, numeral 1 denotes a rotary conveyor, in its entirety, for production machines 2 designed to handle containers 3, and in particular for capping machines.

The rotary conveyor 1 comprises a supporting shaft of conventional embodiment (not illustrated) centred on a main axis X of a production machine 2 for handling containers 3 (FIG. 1), such as a capping machine, by way of example. To advantage, the shaft of the conveyor 1 coincides with the rotating shaft of the production machine 2.

As illustrated in FIG. 1, the conveyor 1 presents a carrier element 4 preferably of disc-like embodiment, coupled to and rotatable as one with the supporting shaft about the main axis X of the machine 2.

The conveyor 1 further comprises a plurality of gripper mechanisms 5 associated operationally with the carrier element 4, distributed circumferentially about the supporting shaft and the main axis X of the production machine 2. Each gripper mechanism 5 is switchable between at least a first configuration (FIGS. 2 and 3), creating a recess 6 in which to accommodate a respective container 3, and a second configuration (FIG. 1) in which the container 3 is held in the recess 6 under a predetermined restraining force exerted by the mechanism. In other words, when the gripper mechanism 5 assumes the second configuration, it applies gentle pressure to the container 3 so as to keep the selfsame container within the recess 6.

To advantage, each gripper mechanism 5 can also be switched from the second configuration (FIG. 1) to a third configuration (not illustrated) in which the restraining force or lateral pressure exerted on the container 3 is greater than the restraining force exerted in the second configuration. The third configuration is assumed preferably by each gripper mechanism 5 to counteract a possible rotation of the container 3 about its longitudinal axis Y, induced during particular handling steps performed by the production machine 2 such as, for example, the twisting of a cap 3*a* onto the open top, or indeed any other operation that can cause the container 3 to rotate on its axis.

In greater detail, the restraining force of each gripper mechanism 5 is generated by means of a pair of gripper plates 7 that can be spread apart or drawn together in a substantially horizontal direction Z (FIG. 2) to establish the different configurations of the respective gripper mechanism 5.

As illustrated in the accompanying drawings, the single gripper plates 7 of each gripper mechanism 5 present a first end 7*a* fixed to a respective motion-inducing rod 8 extending substantially parallel to the main axis X of the production machine 2, and a second end 7*b* opposite to the first end 7*a*, positioned to engage the respective container 5.

To advantage, the two motion-inducing rods 8 of each gripper mechanism are pivotable about their respective longitudinal axes A in mutually opposite directions of rotation, in such a way as to spread apart and draw together the gripper plates 7 as aforementioned.

More precisely, the pivoting motion of rods 8 about their longitudinal axes A induces a rotational movement in the respective plates 7, of which the second ends 7*b* are made to draw together or spread apart according to the direction of the pivoting motion generated through the rods 8.

In greater detail, each gripper plate 7 presents a substantially flat connecting portion 7*c*, located at the aforementioned first end 7*a*. The connecting portion 7*c* is secured to a respective flat surface 8*a* of the relative rod 8 by means of at least one fastening element 9, and preferably by three such elements.

The connecting portion 7*c* of each gripper plate 7 is joined to a substantially flat intermediate portion 7*d*, extending from the connecting portion 7*c* in a direction angled away from this same portion and divergently from the other plate 7 of the respective gripper mechanism 5.

Each gripper plate 7 further comprises a contact portion 7*e* joined to the intermediate portion 7*d*. Located advantageously at the second end 7*b* of the plate, the contact portion 7*e* presents a substantially flat structure and is angled, relative to the intermediate portion 7*d*, in a direction substantially convergent with the other plate 7 of the respective gripper mechanism 5.

Figure 2:
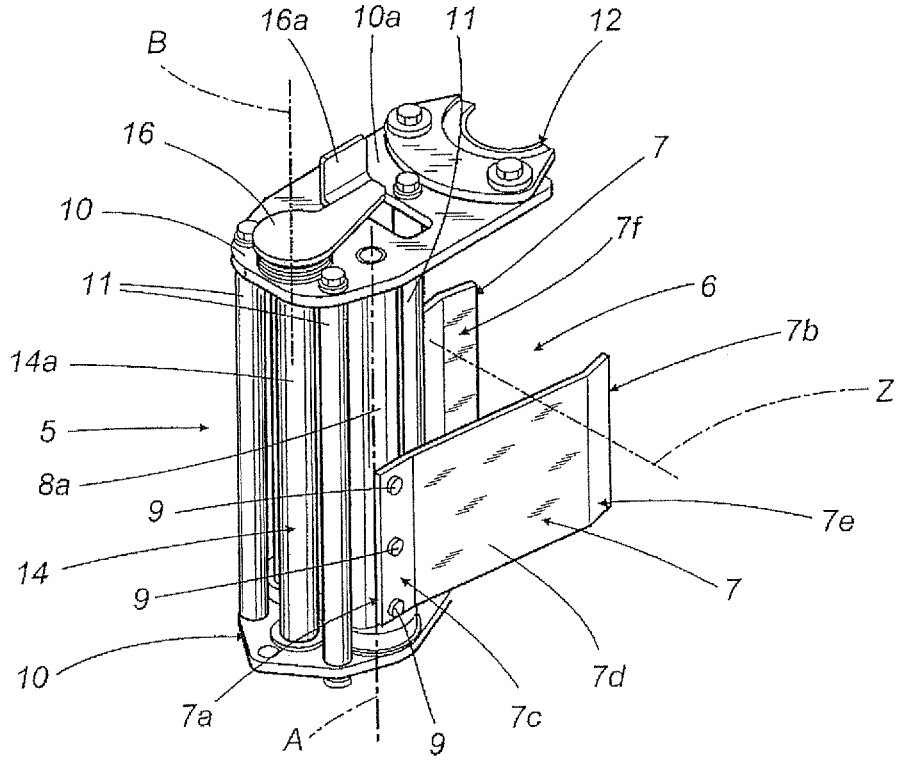
FIG. 2 is a rear perspective view showing a detail of the conveyor illustrated in FIG. 1.
Figure 3:
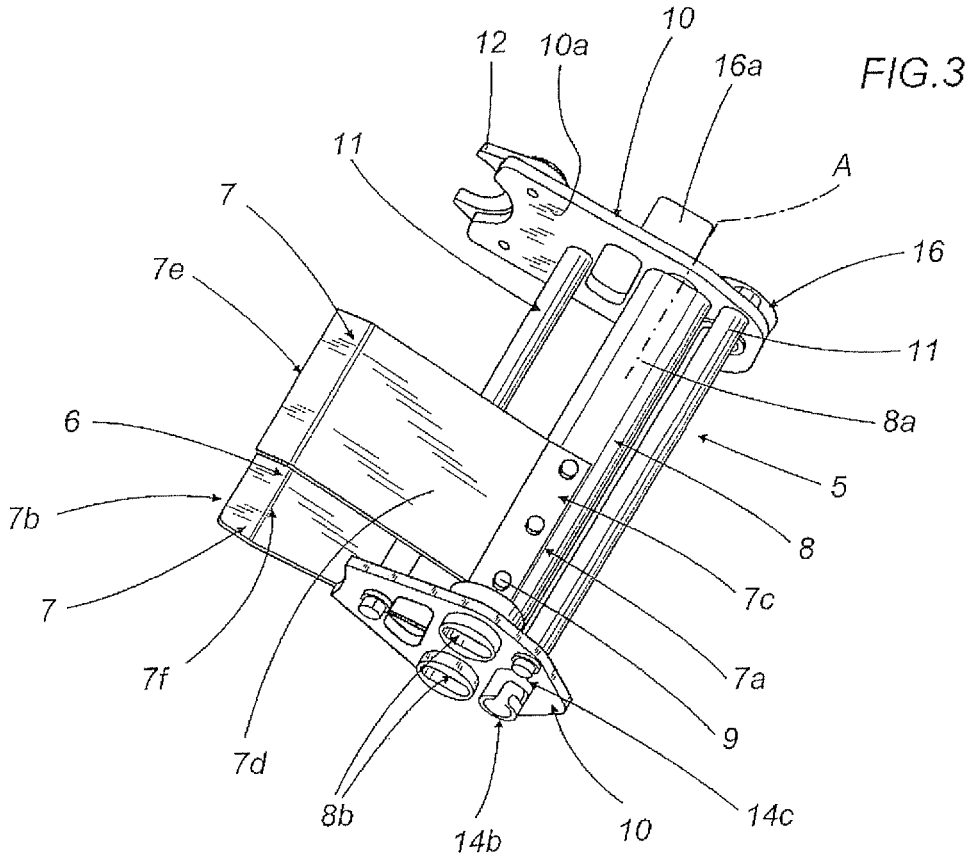
FIG. 3 is a further perspective view showing the detail of FIG. 2 from beneath.

Referring to FIGS. 2 and 3, the intermediate and contact portions 7*d* and 7*e* of each gripper plate 7 combine to delimit at least one indented portion 7*f* against which the side wall 3*b* of a respective container 3 handled by the machine is cradled, at least in part.

As discernible in the drawings, the motion-inducing rods 8 are interposed pivotably between two mounting plates 10 extending substantially parallel one to another and set substantially at right angles to the selfsame rods 8.

The mounting plates 10 are fixed to one another by means of at least one interconnecting rod 11, and preferably three such rods, running substantially parallel to the motion-inducing rods 8. The interconnecting rods 11 thus combine with the mounting plates 10 to form a rigid frame, or cage, serving to carry the moving parts of the relative gripper mechanism 5.

Each mounting plate 10 presents a contact end 10*a* remote from an end associated with the motion-inducing rods 8, by which the body of a respective container 3 being handled, and preferably the neck 3*c* of the selfsame container, is cradled laterally.

To advantage, at least one of the mounting plates 10 is equipped with a rest element 12 fastenable to the aforementioned contact end 10*a*. The rest element 12 preferably presents a concave profile on the side farthest from the motion-inducing rods 8 and is shaped in part to match a lateral portion of the neck 3*c* presented by the respective container 3 being handled.

As shown in FIG. 3, each motion-inducing rod 8 presents a respective driven coupling member 8*b* engageable with a respective driving coupling member 13 (FIG. 1) mounted pivotably to the carrier element 4 of the conveyor 1, so that a rotational movement generated through each driving member 13 will produce a corresponding rotational movement of the respective driven member 8*b* and the associated motion-inducing rod 8.

In a preferred embodiment, the driven coupling member 8*b* of each rod 8 presents at least one socket designed to accept a respective boss 13*a* presented by the respective driving member 13 on the carrier element 4, which is insertable into the socket in a direction substantially parallel to the main axis X of the conveyor 1.

The sockets of the driven members 8*b* and the bosses 13*a* of the driving members 13 are embodied preferably with profiles matched, at least partially, in such a way as to ensure a correct axial coupling one with another.

In accordance with the present invention, each gripper mechanism 5 comprises a fixture element 14 engageable with the carrier element 4 of the conveyor 1, which serves to secure the connection between the selfsame carrier element and the gripper mechanism 5.

Advantageously, the fixture element 14 comprises a motion-inducing spindle 14*a* extending substantially parallel with the motion-inducing rods 8 and is interposed rotatably between the mounting plates 10 of the gripper mechanism 5. The fixture element 14 further comprises a slotted bush 14*b* (FIG. 3) associated with the motion-inducing spindle 14*a* and rotatable together with the spindle about a respective longitudinal axis denoted B (FIG. 2). The slotted bush 14*b* is positioned at one end 14*c* (FIG. 3) of the spindle 14*a*, which passes through one of the two mounting plates 10. The bush 14*b* is advantageously rotatable together with the spindle 14*a* between a release position (FIGS. 2 and 3), in which the relative gripper mechanism 5 is disconnectable from or connectable to the carrier element 4, and a locked position (FIG. 1) in which the slotted bush 14*b* is coupled bayonet fashion to a respective anchor element 15 (FIG. 1) associated permanently with the carrier element 4.

The fixture element 14 further comprises an operating element 16 associated with the end of the motion-inducing spindle 14*a* opposite from the end 14*c* presenting the slotted bush 14*b*. To advantage, the operating element 16 is rotatable as one with the motion-inducing spindle 14*a* about the longitudinal axis B of the selfsame spindle.

The operating element 16 will be furnished preferably with at least one control portion 16*a*, created for example by bending a plate of the operating element 16 so as to fashion a lever, which can be shifted manually by an operator so as to lock or release the respective gripper mechanism 5 to or from the carrier element 4 of the conveyor 1.

Advantageously, according to the invention, each gripper mechanism 5 is interchangeable with other mechanisms 5 of different size so as to provide a recess 6 capable of accommodating a different type or style of container 3. It will be appreciated however that all gripper mechanisms 5 fitted to the conveyor must be furnished with the same coupling members 8*b* and the same type of slotted bush 14*b*.

The drawbacks associated with the prior art are overcome by the present invention, and the stated objects duly realized.

First and foremost, the conveyor according to the invention is able to counteract enforced angular movements that can be induced in containers by machine units such as capping assemblies, during the steps in which caps are fitted to the containers. In this way, the containers are held in the same position within the recess afforded by each gripper mechanism, thereby ensuring a correct closure of the containers on the one hand, and preserving their structural integrity on the other. In effect, the conveyor according to the present invention is able to operate without lateral restraints, or surfaces along which the containers are caused to slide, since the containers are held firmly and elevated above the carrier element while on the carousel.

In the conveyor according to the present invention, moreover, the gripper mechanisms are associated quick-releasably with the carrier element in such a way that washing or cleaning operations on the machine, of whatever nature, can be performed swiftly and efficiently. This same feature also ensures that machines equipped with the conveyor disclosed will acquire a significant degree of flexibility in terms of adaptation to different packaging formats, that is to say, when the machine has to be supplied with containers presenting dimensions different to those currently being handled. In this situation, the quick-fit and quick-release action allows the gripper mechanisms in use to be replaced swiftly with other gripper mechanisms capable of admitting and handling the new containers for capping.

The invention claimed is:

1. A rotary conveyor for production machines for handling containers in which a single container is caused to rotate about its own longitudinal axis (Y) during handling step, comprising:

a supporting shaft centered on a main axis (X), a carrier element coupled to and rotatable as one with the supporting shaft about the main axis (X), a plurality of gripper mechanisms associated operationally with the carrier element and distributed circumferentially about the supporting shaft, each one switchable at least between a first configuration establishing a recess to accommodate a respective container, and a second configuration in which the container is retained in the recess through the application of a predetermined force exerted by the gripper mechanism;

each gripper mechanism being switchable also from the second configuration to a third configuration in which a respective container is restrained by a retaining force greater than the force exerted in the second configuration; and the third configuration being assumed by the single gripper mechanism to counteract a possible rotation of the container about its longitudinal axis (Y) during the course of the handling step;

at least one of the gripper mechanisms including a driven coupling member engageable with a driving coupling member mounted pivotably to the carrier element of the conveyor, such that a rotational movement generated through the driving member will produce a corresponding rotational movement of the driven member for operating the gripper mechanism.

2. A conveyor as in claim 1, wherein each gripper mechanism comprises at least one pair of gripper plates that can be distanced from or drawn toward one another to establish the different configurations of the respective gripper mechanism.

3. A conveyor as in claim 2, wherein each gripper plate of each gripper mechanism includes a first end, fastened to one of two respective motion-inducing rods extending substantially parallel to the main axis (X) of the conveyor and pivotable about respective longitudinal axes (A) in mutually opposite directions of rotation such that the gripper plates can be drawn together or spread apart, and a second end remote from the first end, positioned to engage a relative container.

4. A conveyor as in claim 3, wherein each gripper plate includes a substantially flat connecting portion located at the first end, secured to a corresponding flat surface of the respective motion-inducing rod by at least one fastening element, a substantially flat intermediate portion, extending from the connecting portion in a direction angled away from the connecting portion and divergently from the other plate of the respective gripper mechanism, and a substantially flat contact portion located at the second end, angled relative to the intermediate portion in a direction substantially convergent with the other plate of the respective gripper mechanism such that the intermediate and contact portions combine to delimit at least one indented portion against which the side wall of a respective container handled by the machine is cradled, at least in part.

5. A conveyor as in claim 3, wherein the motion-inducing rods are interposed pivotably between two mounting plates extending substantially parallel one to another and set substantially at right angles to the motion-inducing selfsame rods, the mounting plates being fixed one to another by at least one interconnecting rod disposed substantially parallel to the motion-inducing rods.

6. A conveyor as in claim 5, wherein each mounting plate includes a contact end, positioned remote from an end associated with the motion-inducing rods, by which the body of a respective container being handled is cradled laterally.

7. A conveyor as in claim 6, wherein at least one of the mounting plates is equipped with a rest element fastenable to the contact end, including a concave profile on a side farthest from the motion-inducing rods and shaped at least in part to match a lateral portion of the container being handled.

8. A conveyor as in claim 3, wherein each motion-inducing rod includes a respective driven coupling member engageable with a respective driving coupling member mounted pivotably to the carrier element of the conveyor, such that a rotational movement generated through the driving member will produce a corresponding rotational movement of the respective driven member and the associated motion-inducing rod.

9. A conveyor as in claim 8, wherein the driven coupling member of each motion-inducing rod includes at least one socket for accepting a respective boss of the respective driving coupling member on the carrier element of the conveyor, insertable in a direction substantially parallel to the main axis (X) of the conveyor, the sockets of the driven members and the bosses of the driving members including matched profiles, at least in part.

10. A conveyor as in claim 3, wherein each gripper mechanism comprises a fixture element engageable with the carrier element for securing a connection between the carrier element and the gripper mechanism.

11. A conveyor as in claim 10, wherein the fixture element comprises:

a motion-inducing spindle extending substantially parallel with the motion-inducing rods and interposed pivotably between the mounting plates of the respective gripper mechanism;

a slotted bush associated with the motion-inducing spindle and rotatable together with the spindle about a respective longitudinal axis (B), positioned at one end of the motion-inducing spindle passing through one of the mounting plates and rotatable between a release position, in which the respective gripper mechanism is disconnectable from the carrier element, and a locked position, in which the slotted bush is coupled to a respective anchor element of the carrier element, thereby securing the respective gripper mechanism to the carrier element;

an operating element associated with the motion-inducing spindle at an end opposite from the slotted bush, rotatable as one with the motion-inducing spindle about the longitudinal axis (B) of the motion-inducing spindle.

12. A conveyor as in claim 11, wherein the operating element includes at least one manually activatable control portion.

13. A conveyor as in claim 11, wherein each gripper mechanism is interchangeable with other gripper mechanisms having identical driven coupling members and an identical slotted bush and presenting different dimensions, to provide a recess for accommodating a different type or style of container.

14. A capping machine comprising a drum comprising:

a set of capping units distributed circumferentially about a main axis (X) of rotation, each carrying a respective capping head equipped with a respective gripper;

an infeed station at which containers are taken up by the machine, a station supplying caps for application to the containers, and an outfeed station at which containers capped by the capping units are released from the machine, a rotary conveyor as in claim 1, interposed and operating between the infeed and outfeed stations in conjunction with the capping units.

15. A rotary conveyor for production machines for handling containers in which a single container is caused to rotate about its own longitudinal axis (Y) during a handling step, comprising:

a supporting shaft centered on a main axis (X), a carrier element coupled to and rotatable as one with the supporting shaft about the main axis (X), a plurality of gripper mechanisms associated operationally with the carrier element and distributed circumferentially about the supporting shaft, each one switchable at least between a first configuration establishing a recess to accommodate a respective container, and a second configuration in which the container is retained in the recess through the application of a predetermined force exerted by the gripper mechanism;

each gripper mechanism being switchable also from the second configuration to a third configuration in which a respective container is restrained by a retaining force greater than the force exerted in the second configuration; and the third configuration being assumed by the single gripper mechanism to counteract a possible rotation of the container about its longitudinal axis (Y) during the course of the handling step;

at least one of the gripper mechanisms including a driven coupling member engageable with a driving coupling member mounted pivotably to the carrier element of the conveyor, such that a rotational movement generated through the driving member will produce a corresponding rotational movement of the driven member for operating the gripper mechanism;

wherein each gripper mechanism comprises a fixture element engageable with the carrier element for securing a connection between the carrier element and the gripper mechanism; wherein the fixture element comprises:

a motion-inducing spindle for actuating the gripper mechanism;

a slotted bush associated with the motion-inducing spindle and rotatable together with the motion-inducing spindle about a respective longitudinal axis (B), positioned at one end of the motion-inducing spindle and rotatable between a release position, in which the gripper mechanism is disconnectable from the carrier element, and a locked position, in which the slotted bush is coupled to an anchor element of the carrier element, thereby securing the gripper mechanism to the carrier element.

16. A conveyor as in claim 15, wherein the fixture element further comprises:

an operating element associated with the motion-inducing spindle at an end opposite from the slotted bush, rotatable as one with the motion-inducing spindle about the longitudinal axis (B) of the motion-inducing spindle.

17. A conveyor as in claim 16, wherein the operating element includes at least one manually activatable control portion.

18. A conveyor as in claim 16, wherein each gripper mechanism is interchangeable with other gripper mechanisms having identical driven coupling members and an identical slotted bush and presenting different dimensions, to provide a recess for accommodating a different type or style of container.

19. A capping machine comprising a drum comprising:

a set of capping units distributed circumferentially about a main axis (X) of rotation, each carrying a respective capping head equipped with a respective gripper;

an infeed station at which containers are taken up by the machine, a station supplying caps for application to the containers, and an outfeed station at which containers capped by the capping units are released from the machine, a rotary conveyor as in claim 15, interposed and operating between the infeed and outfeed stations in conjunction with the capping units.

* * * * *